US007296793B2

(12) United States Patent
Yoshino

(10) Patent No.: US 7,296,793 B2
(45) Date of Patent: Nov. 20, 2007

(54) SHEET PROCESSING APPARATUS AND IMAGE FORMING APPARATUS

(75) Inventor: Daiju Yoshino, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 370 days.

(21) Appl. No.: 10/826,314

(22) Filed: Apr. 19, 2004

(65) Prior Publication Data

US 2004/0212136 A1 Oct. 28, 2004

(30) Foreign Application Priority Data

Apr. 22, 2003 (JP) ..... 2003-116768
Jan. 29, 2004 (JP) ..... 2004-020857

(51) Int. Cl.
*B65H 9/10* (2006.01)

(52) U.S. Cl. ..... 271/233; 270/58.17

(58) Field of Classification Search ..... 271/207, 271/220, 221; 270/58.01, 58.08, 58.11, 58.12, 270/58.16, 58.17, 58.27
See application file for complete search history.

(56) References Cited

U.S. PATENT DOCUMENTS 5,241,355 A * 8/1993 Yamashita et al. ..... 399/407
6,120,020 A * 9/2000 Asao ..... 271/189
6,142,461 A * 11/2000 Asao et al. ..... 270/58.09
6,244,583 B1 * 6/2001 Ohmichi et al. ..... 270/58.09
6,302,389 B1 * 10/2001 Kato et al. ..... 270/58.13
6,328,299 B1 * 12/2001 Coombs ..... 270/58.08
6,561,709 B2 * 5/2003 McVeigh et al. ..... 400/625
6,962,331 B2 * 11/2005 Matsumoto et al. ..... 270/58.09
7,007,948 B2 * 3/2006 Kamiya et al. ..... 271/221
2003/0214090 A1 11/2003 Kato et al. ..... 270/12

* cited by examiner

*Primary Examiner*—Patrick Mackey
*Assistant Examiner*—Jeremy R. Severson
(74) *Attorney, Agent, or Firm*—Fitzpatrick, Cella, Harper & Scinto

(57) ABSTRACT

The present invention relates to a sheet processing apparatus aligning and stacking a sheet comprising: a stacking means for stacking the sheet or sheet bundle; a conveying means for conveying the sheet or sheet bundle toward the stacking means; a sheet rear end aligning means for aligning rear end of the sheet or sheet bundle upon pressing toward the stacking means the rear end of the sheet or sheet bundle conveyed by the conveying means; and a controlling means for controlling operation of the sheet rear end aligning means. The controlling means controls the operation of the sheet rear end aligning means so that acceleration $\alpha$ of the sheet or sheet bundle by pressing of the sheet rear end aligning means satisfies a relation: $\alpha \leqq -\mu_1'g$ and $\alpha \leqq -\mu_2'g$; where acceleration of the sheet or sheet bundle by pressing of the sheet rear end aligning means at a time that the sheet rear end aligning means presses the rear end of the sheet or sheet bundle to align the rear end, is denoted as $\alpha$, where gravitational acceleration is denoted as g, where coefficient of kinetic friction between the sheet or sheet bundle pressed by the sheet rear end aligning means and the stacking means is denoted as $\mu_1'$, and where coefficient of kinetic friction between the sheet or sheet bundle pressed by the sheet rear end aligning means and the sheet or sheet bundle already stacked on the stacking means is denoted as $\mu_2'$.

20 Claims, 8 Drawing Sheets

SHEET PROCESSING APPARATUS AND IMAGE FORMING APPARATUS

BACKGROUND OF THE INVENTION

This invention relates to a sheet processing apparatus aligning and stacking sheets and an image forming apparatus having this sheet processing apparatus.

DESCRIPTION OF RELATED ART

In image forming apparatuses such as photocopiers and printers, conventionally, sheet S on which images are formed with an image forming apparatus body 300 as shown in FIG. 7 are temporarily stacked in a processing tray 140 in a sheet processing apparatus 100, and the sheet S are then subject to a sheet post-processing such as alignment and stapling of the sheets. The sheet S on which the sheet post-processing is made are delivered in a bundled manner onto a stacking tray 400 having an inclined stacking surface by bundle delivering means 108; the delivered sheet bundle S is moved by the self-weight over the inclined stacking surface of the stacking tray 400; the rear ends of the sheet bundle is aligned at a rear end aligning wall. The stacking sheet number on the stacking tray 400 is depending on an up and down movable stroke of the stacking tray 400.

However, as shown in FIG. 7, with the stacking tray 400 having the conventional inclined stacking surface, where sheet not so rigid or sheet having a strong downward curling in which the sheet end is bent toward the stacking surface side, are stacked, folding may occur due to the self-weight caused by the steep slope, so that there raises a problem that alignment property of stacking sheets may be reduced.

When the sheet bundle S on which the stapling processing is made are stacked on the stacking tray 400 as shown in FIG. 8, a staple H1 of the sheet bundle S1 already stacked on the stacking tray 400 may engage with a rear end of a sheet bundle S2 delivered in a bundled manner, and therefore, the rear end of the sheet bundle S2 may not slide down to the rear end alignment wall 70, so that the stacked sheet bundles S1, S2 are positionally shifted in the conveyance direction, thereby raising a problem on stacking alignment property.

SUMMARY OF THE INVENTION

It is an object of the invention to provide an apparatus preventing stacked sheet bundles from positionally shifting in the conveyance direction and improving stacking alignment property of the sheet bundles.

Further objects of the invention will be apparent from reading the following detailed description in reference to the attached drawings.

DETAILED DESCRIPTION OF THE PREFERRED EMBODIMENTS

Figure 1:
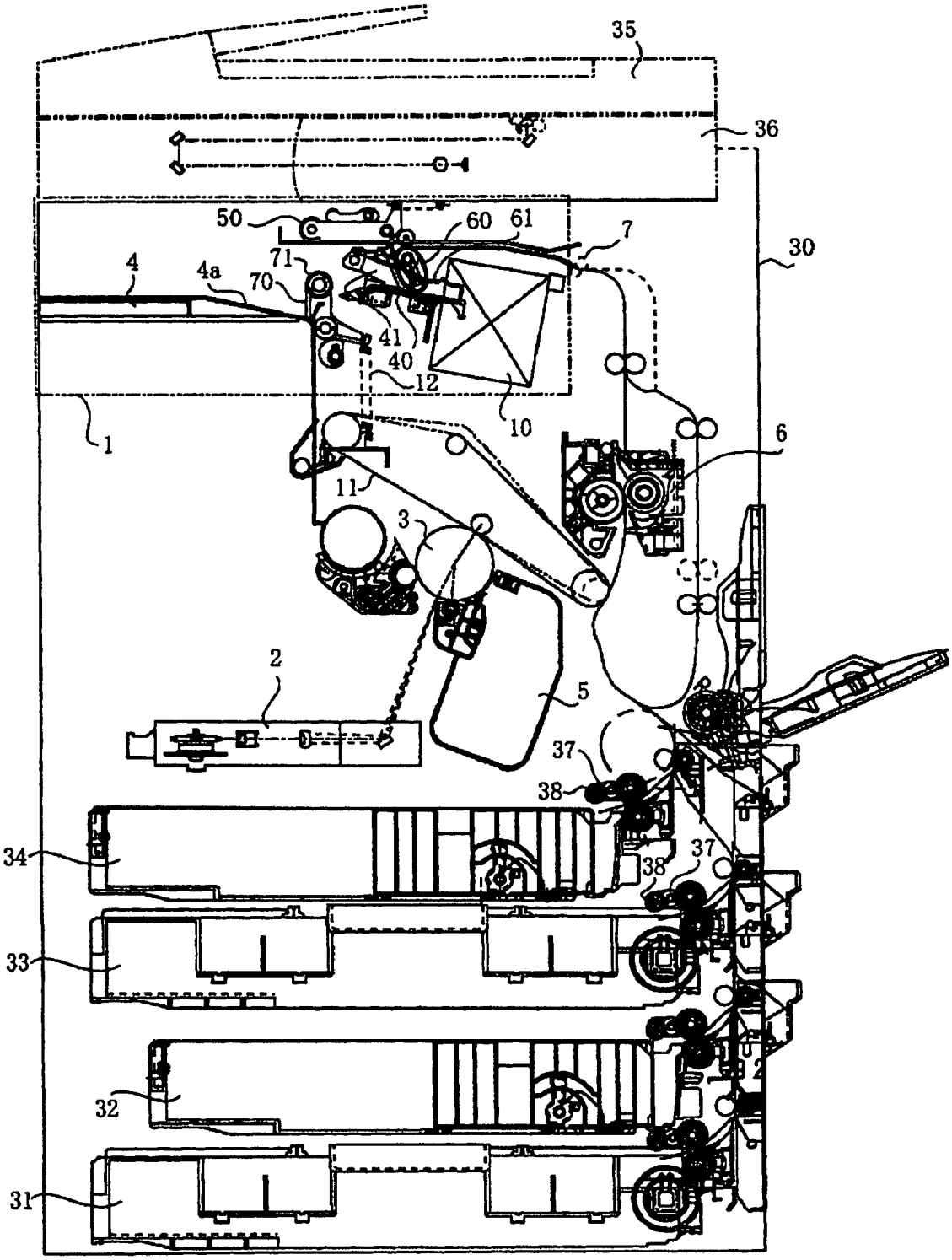
FIG. 1 is a cross section showing the entire structure of an image forming apparatus including a sheet processing apparatus according to an embodiment of the invention.

Referring to the drawings, hereinafter, the preferred embodiments of the invention are described in detail in an exemplifying manner. The sizes, materials, and shapes of structural parts set forth in the following description, correlative positions of those, and the like can be modified properly according to the structure and the various conditions of the apparatus to which this invention applies, and are not intended to render the scope of the invention limited to those only.

Figure 2:
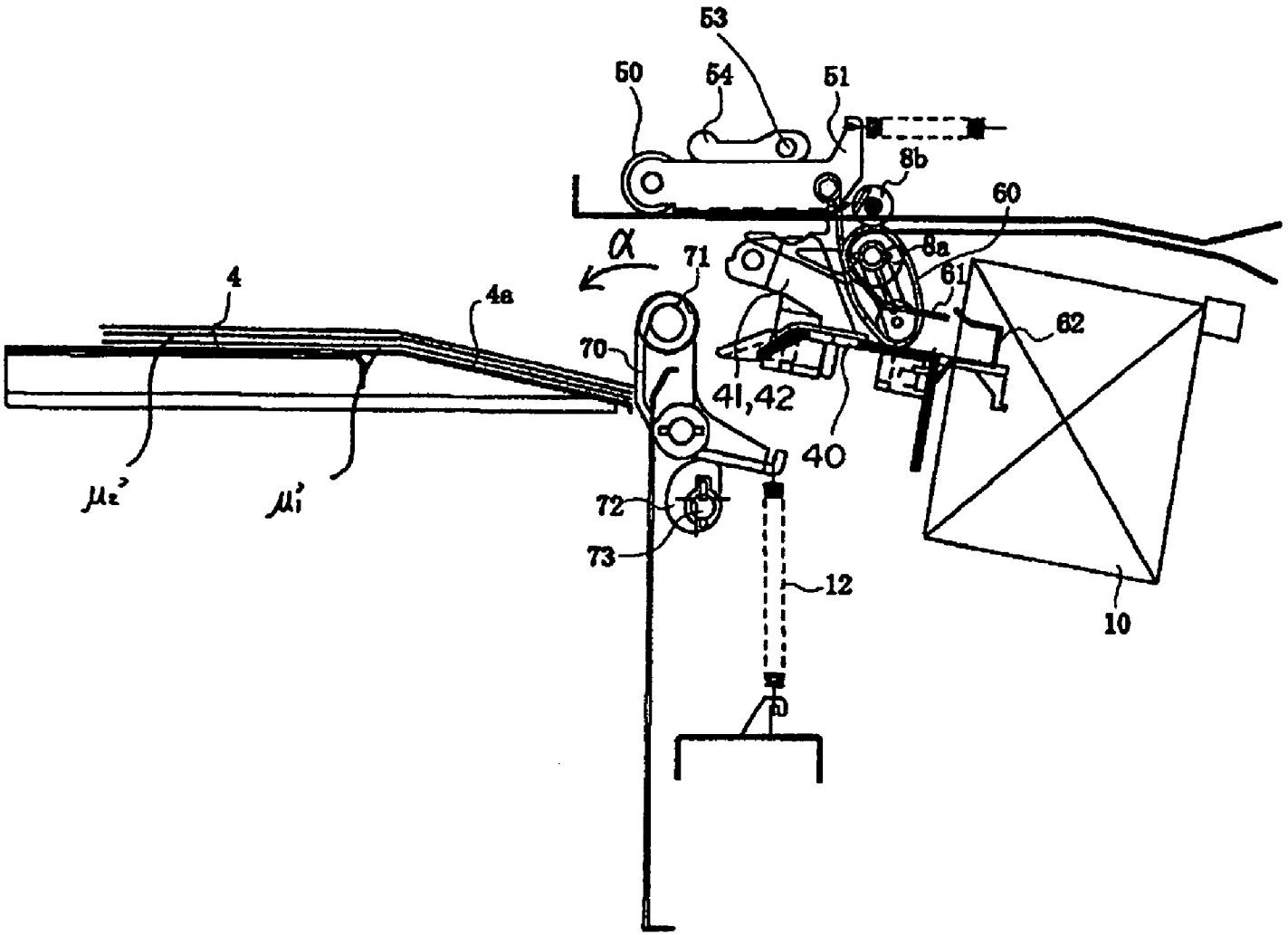
FIG. 2 is a cross section showing a sheet processing apparatus in the image forming apparatus according to the embodiment of the invention.

The embodiment of the image forming apparatus having the sheet processing apparatus according to the invention are exemplified in FIG. 1 and FIG. 2. FIG. 1 is a cross section showing an image forming apparatus 30 mounting a sheet processing apparatus 1 according to an embodiment of the invention; FIG. 2 is a cross section showing the sheet processing apparatus 1.

In this embodiment, the sheet processing apparatus 1 as shown in FIG. 1 is exemplified as the sheet processing apparatus. The sheet processing apparatus 1 is disposed at an upper portion of the image forming apparatus body 30 and at a lower portion of an original document reading apparatus 35. With this sheet processing apparatus 1, the sheet S, on which images are formed, delivered out of the image forming apparatus body 30 are stacked temporarily on a sheet tray 40, and subject to a post-processing such as stapling and alignment. After the post-processing is made, the sheet (or sheet bundle) S after done with the post-processing are aligned at and stacked on a stacking tray 4 arranged as extending substantially horizontally.

This invention, however, is not limited to the example shown in FIG. 1. That is, the sheet processing apparatus is not limited to the apparatus in which the sheet S delivered out of the image forming apparatus body 30, on which images are formed, are aligned at and stacked on the stacking tray 4. For example, this invention is effective for an apparatus in which the sheet processing apparatus is directly connected to an image forming apparatus body 30 not through a processing means having a processing tray 40 or the like, or an apparatus in which the sheet processing apparatus is attached to the exterior of the image forming apparatus body 30.

[Brief Structure of the Image Forming Apparatus]

In FIG. 1, numeral 1 is a sheet processing apparatus mounted on the image forming apparatus body 30 according to this embodiment; an automatic original document reading apparatus 35 is mounted at an upper portion of the image forming apparatus body 30. The sheet processing apparatus 1 can be not with any processing means constituted of the processing tray 40 or the like. The image forming apparatus body 30 is equipped with an image forming section constituted of such as a photosensitive drum 3, a developing device 5, a transfer belt 11.

In the image forming apparatus body 30, the original document by the automatic original document reading apparatus 35 is fed automatically to the reading position as shown in FIG. 1, and images are read at an image reading section 36. Based on this image information, images are formed on the sheet with image forming section as described below. First, a signal is sent to a laser scanner unit 2 based on image information read with a controller, not shown, and laser beam is emitted according to the image information.

Subsequently, the laser beam reflects at a rotating polygon mirror, and is returned at a reflection mirror to be radiated onto a photosensitive drum 3 whose surface is uniformly charged, thereby forming electrostatic latent images. The electrostatic latent image on the photosensitive drum 3 is developed with a developing device 5, and is then transferred onto a sheet S such as paper or OHP sheet as a toner image.

The sheet S is properly selectively fed out of sheet cassettes 31, 32, 33, 34 with a pickup roller 38 constituting the sheet feeding means. The sheet S is conveyed one by one upon separation by a separating means 37, and after corrected with a pre-registration roller pair when fed obliquely, the sheet is fed to a transfer position in synchrony with the rotation of the photosensitive drum 3, so that the toner image formed on the photosensitive drum 3 is transferred to the sheet S via a transfer belt 11 as an intermediate transfer body.

Then, the sheet S is introduced to a fixing roller pair 6, and the toner image transferred to the sheet S is permanently fixed upon application of heat and pressure from the fixing roller pair 6. A fixing upper separation nail and a fixing lower separation nail are in contact with the fixing roller pair 6, and this separates the sheet S from the fixing roller pair 6.

The sheet S on which images are formed thus with the image forming section is further conveyed to the exterior of the image forming apparatus body 30 with a body side delivery roller pair 7, so that the sheet S is introduced into the sheet processing apparatus 1 coupled to the image forming apparatus body 30.

[Brief Structure of the Sheet Processing Apparatus]

In FIG. 1, the sheet processing apparatus 1 includes the stacking tray 4 as a stacking means for stacking the sheet or sheet bundle, a rocking roller 50 serving as a conveying means for conveying the sheet or sheet bundle toward the stacking tray 4, a sheet rear end aligning means made of such as a rear end alignment wall 70 for aligning the rear ends of the sheet or sheet bundle in pressing toward the stacking tray 40 the rear ends of the sheet or sheet bundle conveyed by the rocking roller 50, and a finisher CPU 79 as controlling means for controlling the operation of the sheet rear end aligning means.

A processing means capable of temporarily stacking a plural number of sheets and processing the sheet or sheet bundle is provided on an upstream side of the stacking tray 4 and the rocking roller 50 in the sheet conveyance direction. The processing means according to this embodiment includes a processing tray 40 temporarily stacking a plural number of sheets, an aligning means constituted of alignment plates 41, 42 for aligning sheets stacked on the processing tray 40, and a stapler unit 10 serving as stapling means for stapling processing of sheet bundles aligned with the aligning means. The processing means can have only the aligning means, or may have, other than the aligning means, a punching means for making holes in the sheets, a pasting means for pasting an end of the sheet bundle, and a bookmaking means such as a tape attaching means attaching a binding tape to the end of the sheet bundle.

As shown in FIG. 2, the sheet S delivered out of the delivery roller pair 7 on the body side of the image forming apparatus body 30 is delivered toward the stacking tray 4 from a delivery section 8 made of a delivery roller 8*a* on a side of the sheet processing apparatus 1 and a delivery roller 8*b* driven by the roller 8*a*. The rear end of the sheet S is dropped down by the rocking roller 50 at a timing that the rear end of the sheet S passes through the delivery section 8, and the sheet S is clamped by the rocking roller 50 and a driven roller 71.

The rear end of the sheet S is subsequently fed along a lower guide 61 to the processing tray 40 in the opposite direction to the conveyance direction as conveyed so far by the reverse rotation of the rocking roller 50, and sheets are aligned one by one in the sheet conveyance direction and in the sheet width direction substantially perpendicular to the sheet conveyance direction by the aligning means constituted of such as a returning belt 60 and the alignment plates 41, 42 as described below.

The alignment in the conveyance direction of the sheet S is done by contacting the rear end of the sheet S to a rear end stopper 62 of the sheet S serving as a sheet reception means located at an end of the processing tray 40 for receiving the sheet S on the processing tray 40, from the self-weight force of the sheet S obtained by the inclined angle of the processing tray 40 and from the returning belt 60. The alignment in the sheet width direction is done by the alignment plates 41, 42 arranged on both sides in the sheet width direction operating by a driving means, not shown, e.g., lack and pinion gear drive source, and by the controlling means.

Where the stapling mode is selected, the stapler unit 10 makes stapling to the already aligned sheet bundle S which are aligned on the processing tray 40. The sheet bundle S thus finished with the post-processing are delivered and stacked on the stacking tray 4 arranged to extend substantially horizontally by rotation in the counterclockwise direction in FIG. 2 of the rocking roller 50.

[Alignment of Sheet Rear Ends]

Figure 3:
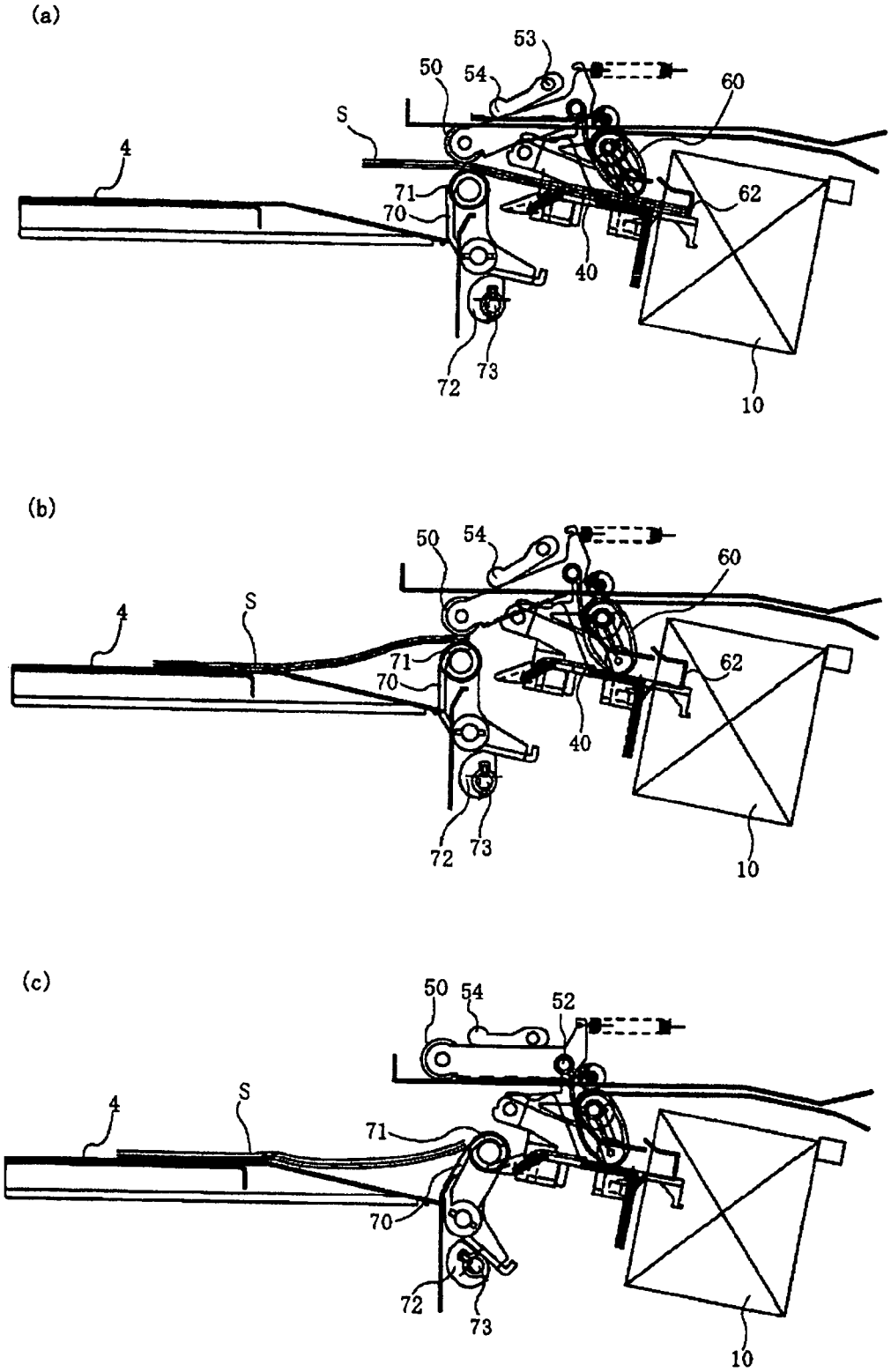
FIG. 3 is a cross section showing delivery operation of the sheet bundle in the sheet processing apparatus according to the embodiment of the invention.
Figure 4:
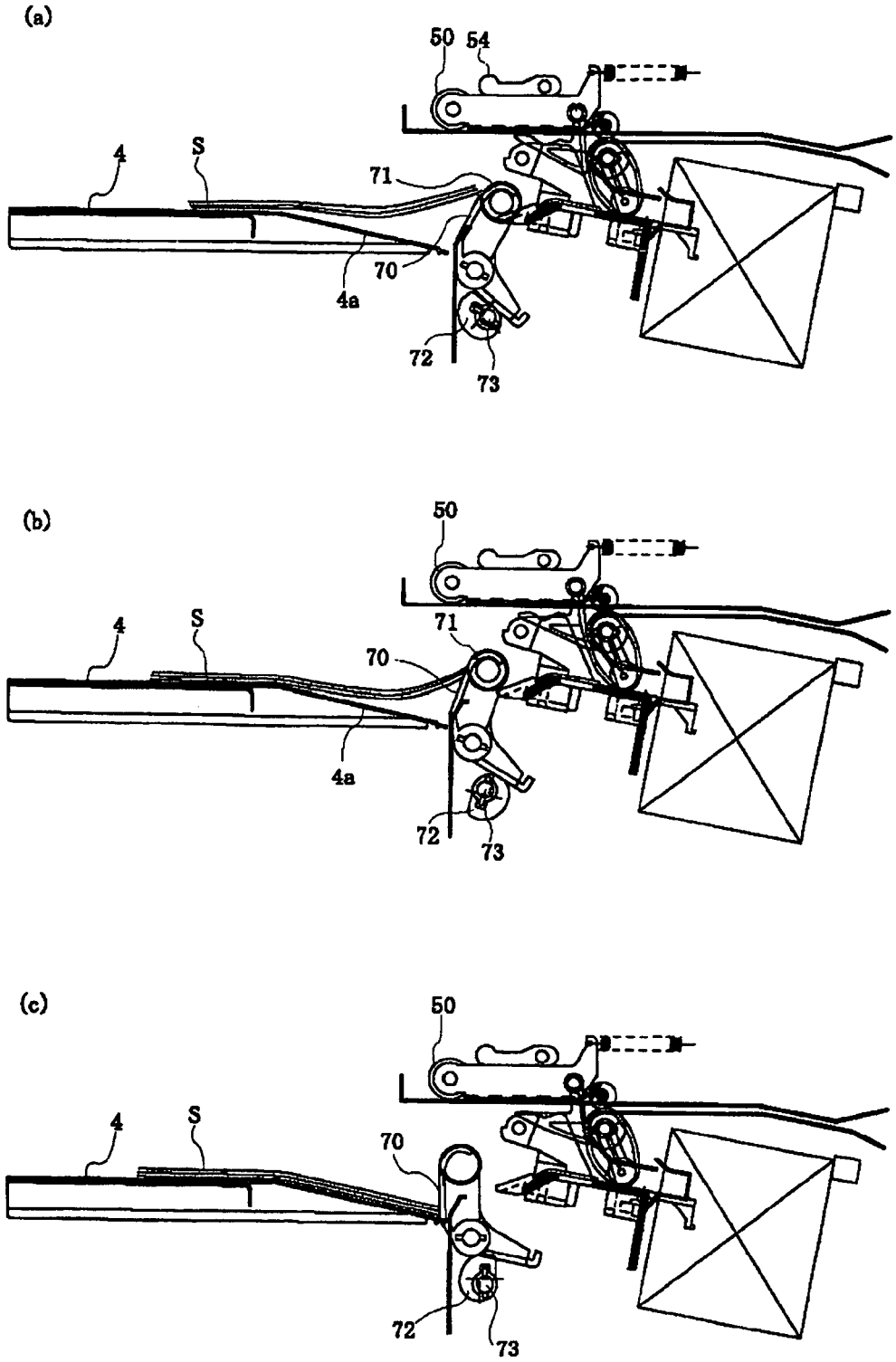
FIG. 4 is a cross section showing alignment operation of the rear ends of the sheet bundle in the sheet processing apparatus according to the embodiment of the invention.
Figure 5:
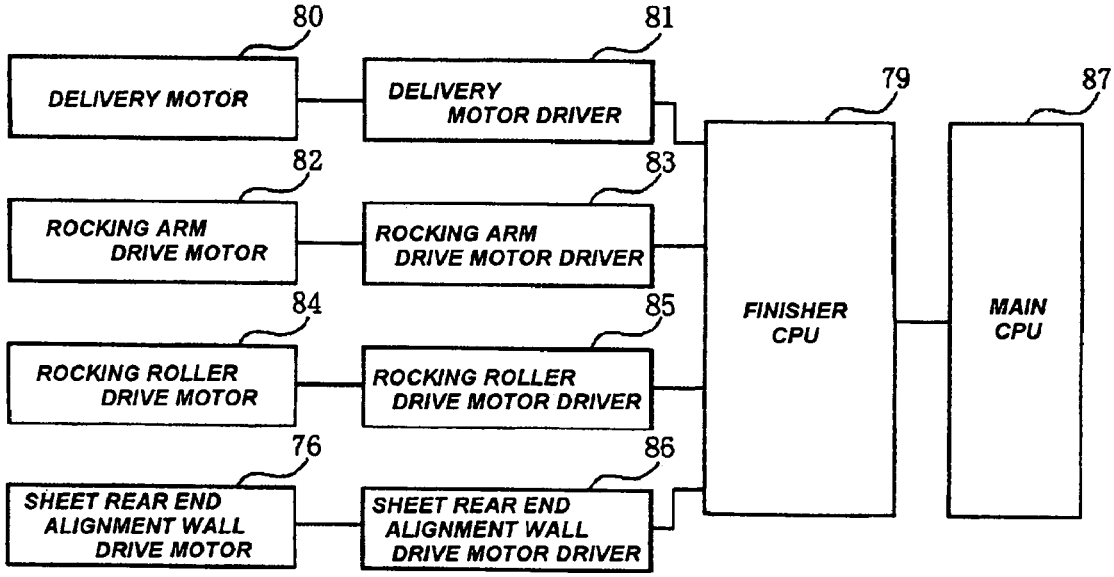
FIG. 5 is a block diagram showing a control system of the sheet processing apparatus according to the embodiment of the invention.

Referring to FIGS. 3 to 5, sheet rear end alignment operation in the sheet processing apparatus 1 is described next in detail. FIG. 3 is a cross section showing delivery operation of the sheet bundle according to the embodiment of the invention; FIG. 4 is a cross section showing alignment operation of the rear ends of the sheet bundle; FIG. 5 is a block diagram showing a control system of the sheet processing apparatus according to the embodiment of the invention.

First, described in reference with FIGS. 3, 4 are means for delivering, aligning, and stacking the already-processed sheet bundle S on the processing tray 40 onto the stacking tray 4. As shown in FIG. 4, the rear end alignment wall 70 constituting the sheet rear end aligning means delivers the sheet bundle S from the processing tray 40 to the stacking tray 4, and serves as an alignment wall for aligning the rear ends of the sheet bundle S when stacking the sheet bundle S. The rear end alignment wall 70 is urged by a spring 12 and positionally regulated to an alignment reference position (see, FIG. 2) upon contacting to a cam 72 located at the home position.

As shown in FIG. 5, a drive signal is transmitted from the finisher CPU 79 as the controlling means of the sheet processing apparatus 1 to a rear end alignment wall drive motor 76 via a rear end alignment wall drive motor driver 86, and the rear end alignment wall 70 is pivotally moved in the sheet conveyance direction by a cam 72 rotating around a rocking rotation shaft 73 as a center upon rotation of the rear end alignment wall drive motor 76.

In FIG. 5, numeral 80 is a delivery motor and rotationally drives the delivery roller 8*a* upon transmitting the drive signal from the finisher CPU 79 via a delivery motor driver 81 to the delivery motor 80. Numeral 82 is a rocking arm drive motor, to which the drive signal from the finisher CPU 79 via a delivery motor driver 83 is transmitted, thereby driving a rocking arm 54 rocking a support arm 51 rotatably supporting the rocking roller 50. Numeral 84 is a rocking roller drive motor, to which the drive signal from the finisher CPU 79 via a delivery motor driver 85 is transmitted, thereby rotatably driving the rocking roller 50. Numeral 87 is a main CPU as a controlling means provided on a side of the image forming apparatus. Although in this embodiment, the operation of the rear end alignment wall 70 is controlled by the finisher CPU 79, the operation can be controlled directly by the main CPU 87 from the side of the image forming apparatus without having any controlling means in the sheet processing apparatus 1.

As shown in FIG. 3, the sheet bundle S stacked on the processing tray 40 (FIG. 3(*b*)) renders the rear end alignment wall 70 escape toward the upstream side in the sheet conveyance direction (FIG. 3(*c*)) as in a state that the rear end of the sheet bundle S conveyed by the bundle delivering means is in contact with a top end of the rear end alignment wall 70 (FIG. 3(*b*)). Where the rear end alignment wall 70 is thus escaped, the rear end alignment wall 70 is inclined as shown in FIG. 4(*a*), and the rear end of the sheet bundle S contacts to the inclined surface of the rear end alignment wall 70. While the rear end alignment wall 70 escaped as shown in FIG. 4(*a*) is returned to the home position (alignment reference position) as shown in FIG. 2 around the rocking rotation shaft 73 as a center, the rear end of the sheet bundle S is pressed by the rear end alignment wall 70, and the sheet bundles S are stacked on the stacking tray 4 (FIG. 4(*c*)) as the rear ends of the sheet bundles S are aligned (FIG. 4(*b*)).

As described above, while the escaped rear end alignment wall 70 is returned to the home position by the rotation of the cam 72, acceleration $\alpha$ of the sheet bundle (or sheet) from pressing of the rear end alignment wall 70 is required to be controlled. This is because the sheet bundle (or sheet) S may be kicked if the acceleration $\alpha$ is high, thereby reducing the alignment property on the stacking tray 4. Conversely, if acceleration $\alpha$ is low, the productivity of the sheet processing apparatus is reduced. To prevent such problems from occurring, the acceleration $\alpha$ of the sheet bundle S due to pressing of the rear end alignment wall 70, or namely, the acceleration $\alpha$ of the rear end alignment wall 70, is required to be controlled.

Figure 6:
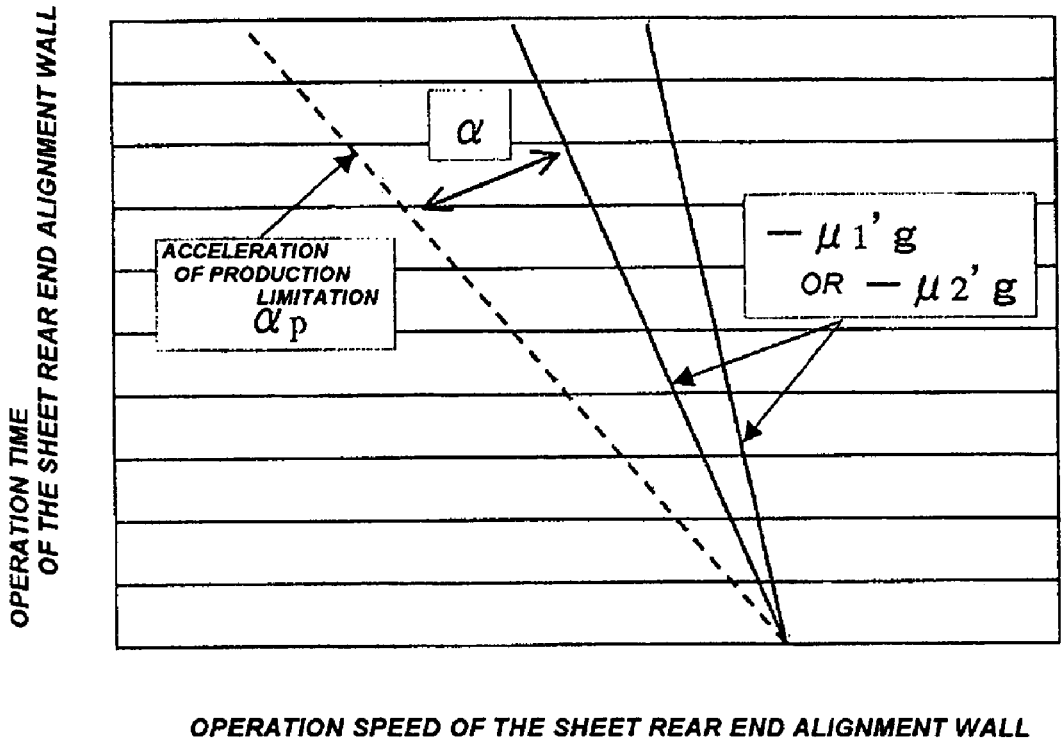
FIG. 6 is a diagram showing conditions of acceleration of a sheet rear end alignment wall in the sheet processing apparatus according to the embodiment of the invention.
Figure 7:
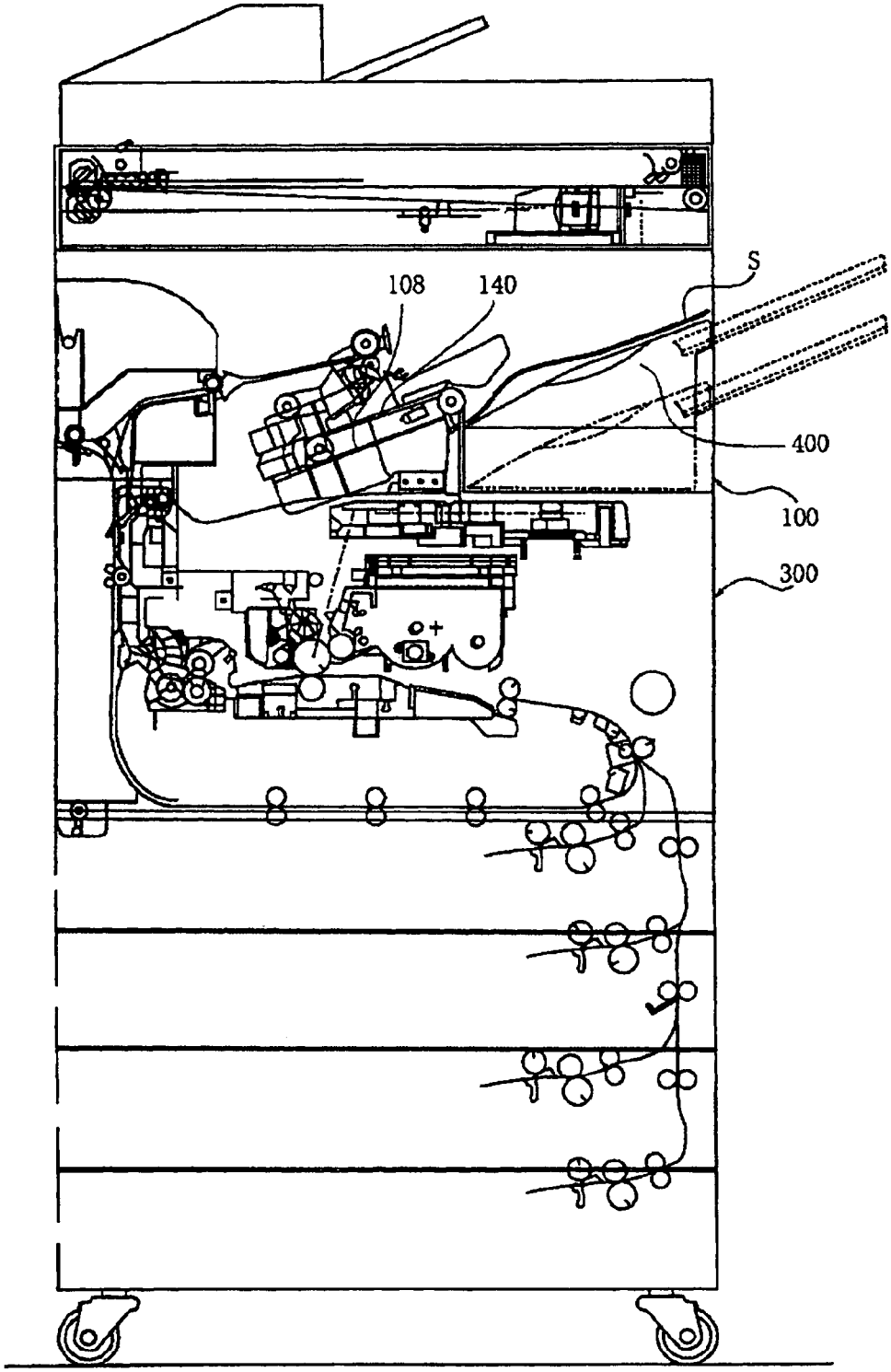
FIG. 7 is a cross section showing the entire structure of the image forming apparatus having conventional sheet processing apparatus.
Figure 8:
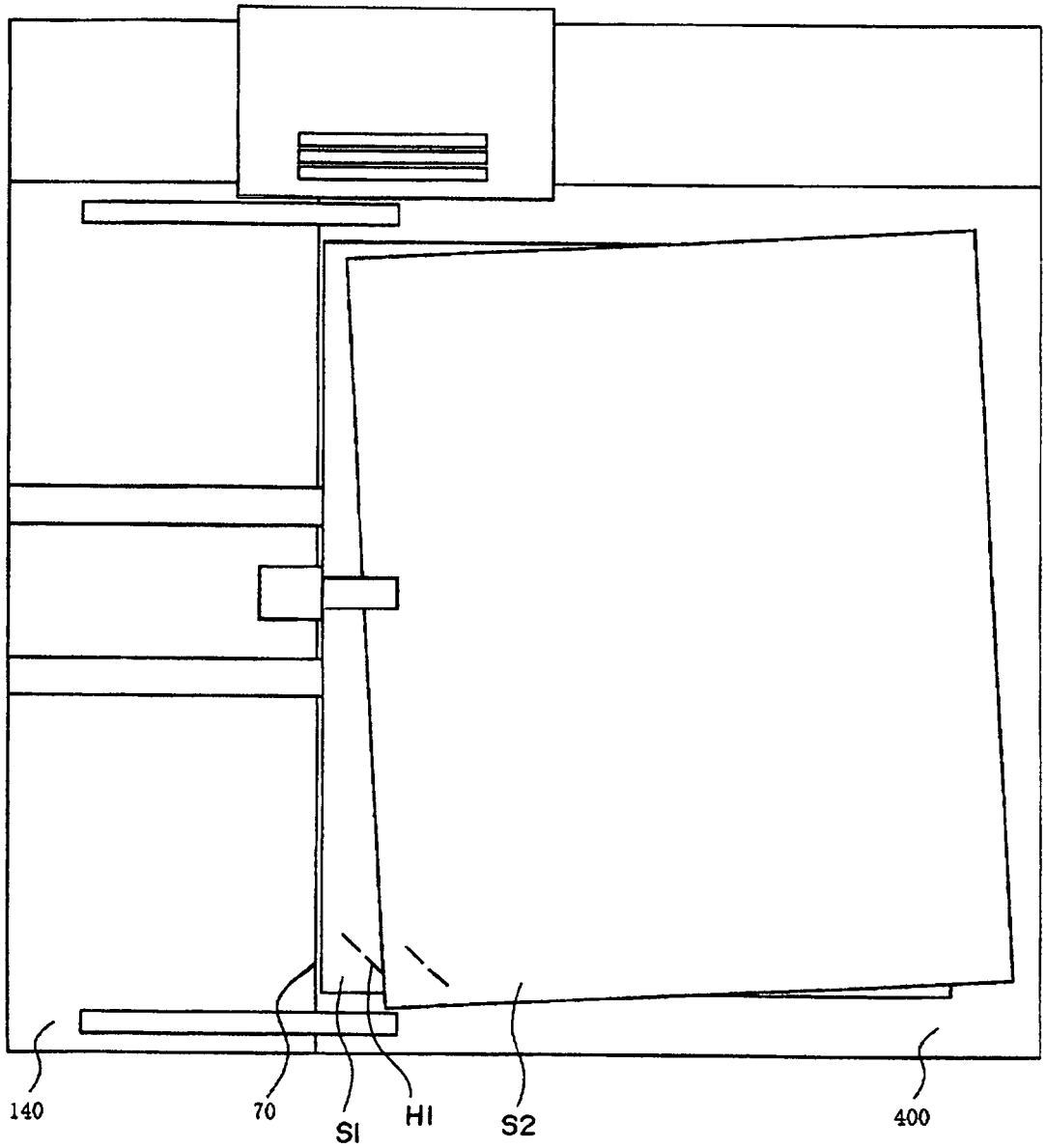
FIG. 8 is a top view showing the conventional sheet processing apparatus.

In this embodiment, where acceleration of the sheet bundle S by pressing of the rear end alignment wall 70 at a time that the rear end alignment wall 70 presses the rear ends of the sheet bundle (or sheet) S to align the rear ends, is denoted as $\alpha$, where gravitational acceleration is denoted as g, where coefficient of kinetic friction between the sheet bundle (or sheet) S pressed by the rear end alignment wall 70 and the stacking tray 4 is denoted as $\mu_1'$, and where coefficient of kinetic friction between the sheet bundle (or sheet) S pressed by the rear end alignment wall 70 and the sheet bundle (or sheet) S already stacked on the stacking tray 4 is denoted as $\mu_2'$, the operation of the rear end alignment wall 70 is controlled, as shown in FIG. 6 by the finisher CPU 79 so that acceleration $\alpha$ of the sheet bundle (or sheet) S by pressing of the rear end alignment wall 70 satisfies a relation:

$$\alpha \leqq -\mu_1' g \text{ and } \alpha \leqq -\mu_2' g$$

The sheet bundle (or sheet) S to be pressed moves upon receiving frictional resistance from the stacking tray 4 or the already stacked sheet bundle (or sheet). That is, where the rear end alignment wall 70 is operated with acceleration $\alpha$ satisfying the above relation, the rear end of the sheet bundle (or sheet) S does not become separated from the rear end alignment wall 70 by the frictional resistance, and the sheets are stacked on the stacking tray 4 as keeping a good alignment state. The relationship in amounts of coefficient of kinetic friction $\mu_1'$ between the sheet bundle S and the stacking tray 4 and the coefficient of kinetic friction $\mu_2'$ between the sheet bundle S and the sheet bundle already stacked on the stacking tray 4 is determined with kinds of the stacked sheets, toner amounts carried on the stacked sheets, materials of the tray, etc.

In FIG. 6, the abscissa denotes operation time of the sheet rear end alignment wall 70; the ordinate is operation speed of the sheet rear end alignment wall 70; the gradient indicates acceleration of the sheet rear end alignment wall 70. In this embodiment, the above controlling formula defines the gradient going down as goes right, or namely the acceleration from the constant speed to the stop. In FIG. 6, to compare the gradient ($\alpha \leqq -\mu_1'g$ and $\alpha \leqq -\mu_2'g$) of the controlling formula with the acceleration of the sheet rear end alignment wall 70, it is denoted with reference to a time that the sheet rear end alignment wall 70 is stopped. As described above, the range of the acceleration $\alpha$ is necessarily set in consideration of the acceleration $\alpha_P$ of production limitation, because positional shifts in the conveyance direction at the front and rear ends of the sheet bundle (or sheet) may occur on the stacking tray 4 if the acceleration $\alpha$ of the sheet bundle S by pressing of the rear end alignment wall 70 is large when the sheet bundle (or sheet) S is pushed by the sheet rear end alignment wall 70 as described above, and because the productivity may be reduced if the acceleration $\alpha$ is small. It is to be noted that the acceleration $\alpha_P$ of production limitation is an acceleration depending on the productivity of the image forming apparatus. To make sure good productivity, it is require to match the time for stacking the sheet bundle (or sheet) S on the stacking tray 4 by pressing the sheet bundle (or sheet) S by the sheet rear end alignment wall 70 with the time for aligning the sheet bundle (or sheet) S subsequently stacked on the processing tray 40. That is, to transfer the sheet bundle (or sheet) S without delay from the processing tray 40 to the stacking tray 4, the acceleration $\alpha$ of the sheet rear end alignment wall 70 is determined by image forming force in the image forming apparatus body in which the sheets are sent onto the processing tray 40. The acceleration $\alpha_P$ of production limitation is the acceleration of the lower limitation not stagnating the sheet bundle (or sheet) S on the processing tray 40. By setting the acceleration $\alpha$ of the sheet bundle (or sheet) S from pressing of the rear end alignment wall 70 within a range shown in FIG. 6, the rear end of the sheet bundle S is adequately aligned without kicking the rear ends of the sheet bundle S, thereby improving alignment property of the sheets in the stacking tray 4, and thereby allowing the processing to be done without reducing the productivity of the sheet processing apparatus 1.

Thus, the operation of the rear end alignment wall 70 is controlled so that the acceleration $\alpha$ of sheet bundle (or sheet) S from pressing of the rear end alignment wall 70 satisfies the above conditions, and therefore, this apparatus can prevent the sheets from positionally shifting in the conveyance direction at the front and rear ends of the sheet bundle (or sheet) S on the stacking tray 4, thereby allowing the sheet bundle (or sheet) S to be delivered and stacked on the stacking tray 4.

It is to be noted that although in this embodiment, the sheet stacking surface 4*a* of the stacking tray 4 is set to extend substantially horizontally, the rear end alignment wall 70 effectively operates even where the sheet stacking surface 4*a* is inclined, and where the sheet stacking surface 4*a* is extending substantially horizontally, the effects itself increase more. Where the sheet stacking surface 4*a* is set with an inclined angle of eighteen degrees or less inclined to the lower side toward the rear end alignment wall 70, a smaller size of the apparatus can be realized as avoiding interference between the rear ends of the sheet bundles already stacked on the stacking tray 4 and the subsequent sheet bundle delivered out of the processing tray 40.

The stacking tray 4 is structured to be movable up and down by a driving means not shown to keep the height of the top surface of the stacked sheet bundles S at a constant level.

As described above, according to this embodiment, the sheets are aligned in the conveyance direction of the sheet bundle (rear end alignment) while delivered and stacked on the stacking tray 4, by conveying the sheets until that the rear end of the sheet bundle (or sheet) reaches the top end of the rear end alignment wall, subsequently by rendering the sheet bundle rear end contact with the rear end alignment wall 70 as escaping the rear end alignment wall 70, and by pressing the rear ends of the sheet bundle with the rear end alignment wall 70. At that time, by controlling the operation of the rear end alignment wall 70 with the finisher CPU 79 so that the acceleration $\alpha$ of sheet bundle from pressing of the rear end alignment wall 70 satisfies the relation of $\alpha \leqq -\mu_1'g$ and $\alpha \leqq -\mu_2'g$, the apparatus can prevent sheets from positionally shifting in the conveyance direction at the front or rear ends of the sheet bundles, and can improve the stacking alignment property of the sheet bundle on the stacking tray 4.

The sheet alignment property on the stacking tray 4 can be improved even where the stacking tray 4 is placed as substantially horizontally extend, and because the space for inclined portion of the stacking tray 4 can be converted to an up and down moving stroke of the stacking tray 4, the number of the sheets stacked on the stacking tray 4 can be made larger without rendering the apparatus body in a larger size.

Moreover, because the inclination of the stacking tray 4 can be made gentle, folding of the sheet due to the self-weight of the sheet bundle subjecting to lower curling or having low rigidity caused by steep inclination of the stacking tray 4, can be prevented.

Because the rear ends of the sheet bundle delivered on the basis of the bundles are aligned on an upstream side in the delivery direction with respect to the sheet bundles already stacked, this apparatus can prevent the sheets from positionally shifting in the conveyance direction upon engagement of the staple of the already stacked sheet bundles on which the stapling processing is made with the rear end of the sheet bundle delivered on the basis of the bundle.

With the embodiment described above, the photocopier is exemplified as an image forming apparatus. This invention is not limited to this, and this invention can be for other image forming apparatuses such as printers or facsimile machines or other image forming apparatuses such as combined machines combining those functions. Substantially the same effects can be obtained upon application of this invention to the sheet processing apparatus used in such an image forming apparatus.

In the embodiment described above, exemplified is the sheet processing apparatus installed in the image forming apparatus body (space portion), but this invention is not limited to this. For example, the sheet processing apparatus can be arranged at the exterior of the image forming apparatus body and can be formed as detachably attached to the image forming apparatus body or formed unitedly with the image forming apparatus body. Substantially the same effects can be obtained upon application of this invention to such a sheet processing apparatus.

In the embodiment described above, the exemplified recording method is an electrophotographic method, but this invention is not limited to this. This invention can use other recording method such as, e.g., inkjet method or the like.

What is claimed is:

1. A sheet processing apparatus aligning and stacking a sheet or sheet bundle comprising:

stacking portion on which the sheet or sheet bundle is stacked;

conveying portion which conveys the sheet or sheet bundle toward the stacking portion;

sheet rear end aligning unit which aligns a rear end of the sheet or sheet bundle upon pressing toward the stacking portion, the rear end of the sheet or sheet bundle conveyed by the conveying portion; and controlling portion which controls acceleration of the sheet rear end aligning unit by determining at least one feature of the sheet or sheet bundle being pressed, wherein the controlling portion controls the acceleration of the sheet rear end aligning unit so that acceleration of the sheet or sheet bundle by pressing of the sheet rear end aligning unit satisfies a relation:

$$\alpha \leqq -\mu_1'g \text{ and } \alpha \leqq -\mu_2'g$$

where acceleration of the sheet or sheet bundle by pressing of the sheet rear end aligning unit at a time that the sheet rear end aligning unit presses the rear end of the sheet or sheet bundle to align the rear end, is denoted as $\alpha$, where gravitational acceleration is denoted as g, where coefficient of kinetic friction between the sheet or sheet bundle pressed by the sheet rear end aligning unit and the stacking portion is denoted as $\mu_1'$, and where coefficient of kinetic friction between the sheet or sheet bundle pressed by the sheet rear end aligning unit and the sheet or sheet bundle already stacked on the stacking portion is denoted as $\mu_2'$.

2. The sheet processing apparatus according to claim 1, further comprising a processing unit capable of temporarily stacking the sheets, disposed on an upstream side of the stacking portion and the conveying portion in the sheet conveyance direction, wherein the sheet or sheet bundle processed by the processing unit is conveyed to the stacking portion by the conveying portion.

3. The sheet processing apparatus according to claim 2, wherein the processing unit includes a processing tray capable of temporarily stacking the sheet or sheet bundle, an aligning unit which aligns the sheet or sheet bundle stacked on the processing tray, and a stapler unit which staples the sheet bundle aligned by the aligning unit.

4. The sheet processing apparatus according to claim 1, wherein the stacking portion has a stacking surface, extending substantially horizontally, which stacks the sheet or sheet bundle.

5. An image forming apparatus comprising:

an image forming section which forms an image on a sheet; and a sheet processing apparatus which aligns and stacks the sheet delivered from the image forming section, wherein the sheet processing apparatus is as set forth in any one of claims 1 to 4.

6. An image forming apparatus, comprising:

an image forming section which forms an image on a sheet or sheet bundle;

stacking portion which stacks the sheet or sheet bundle on which the image is formed by the image forming section;

conveying portion which conveys the sheet or sheet bundle toward the stacking portion;

sheet rear end aligning unit which aligns a rear end of the sheet or sheet bundle upon pressing, toward the stacking portion, the rear end of the sheet or sheet bundle conveyed by the conveying portion; and controlling portion which controls acceleration of the sheet rear end aligning unit by determining at least one feature of the sheet or sheet bundle being pressed, wherein the controlling portion controls the acceleration of the sheet rear end aligning unit so that acceleration of the sheet or sheet bundle by pressing of the sheet rear end aligning unit satisfies a relation:

$$\alpha \leqq -\mu_1' g \text{ and } \alpha \leqq -\mu_2' g$$

where acceleration of the sheet or sheet bundle by pressing of the sheet rear end aligning unit at a time that the sheet rear end aligning unit presses the rear end of the sheet or sheet bundle to align the rear end, is denoted as $\alpha$, where gravitational acceleration is denoted as g, where coefficient of kinetic friction between the sheet or sheet bundle pressed by the sheet rear end aligning unit and the stacking portion is denoted as $\mu_1'$, and where coefficient of kinetic friction between the sheet or sheet bundle pressed by the sheet rear end aligning unit and the sheet or sheet bundle already stacked on the stacking portion is denoted as $\mu_2'$.

7. The image forming apparatus according to claim 6, further comprising processing unit capable of temporarily stacking the sheet or sheet bundle, disposed on an upstream side of the stacking portion and the conveying portion in the sheet conveyance direction, wherein the sheet or sheet bundle processed by the processing unit is conveyed to the stacking portion by the conveying portion.

8. The image forming sheet processing apparatus according to claim 7, wherein the processing unit includes a processing tray capable of temporarily stacking the sheet or sheet bundle, an aligning unit which aligns the sheet or sheet bundle stacked on the processing tray, and a stapler unit which staples the sheet bundle aligned by the aligning unit.

9. The image forming apparatus according to claim 6, wherein the stacking portion has a stacking surface, extending substantially horizontally, which stacks the sheet or sheet bundle.

10. A sheet processing apparatus aligning and stacking a sheet comprising:

a stacking portion on which sheets or sheet bundles are stacked;

a conveying portion which conveys the sheet or sheet bundle toward the stacking portion;

a sheet rear end aligning unit which aligns a rear end of the sheet or sheet bundle upon pressing, toward the stacking portion, the rear end of the sheet or the sheet bundle conveyed by the conveying portion; and a controller which controls acceleration of the sheet rear end aligning unit, such that the acceleration of the sheet rear end aligning unit is determined based on a feature of the sheet or sheet bundle being pressed.

11. The sheet processing apparatus according to claim 10, further comprising a processing unit capable of temporarily stacking the sheet or sheet bundle, disposed on an upstream side of the stacking portion and the conveying portion in the sheet conveyance direction, wherein the sheet or sheet bundle processed by the processing unit is conveyed to the stacking portion by the conveying portion.

12. The sheet processing apparatus according to claim 11, wherein the processing unit includes a processing tray capable of temporarily stacking the sheet or sheet bundle, an alignment unit which aligns the sheet or sheet bundle in the sheet width direction, stacked on the processing tray, and a stapler unit which staples the sheets aligned by the alignment unit.

13. The sheet processing apparatus according to claim 10, wherein the stacking portion has a stacking surface, extending substantially horizontally, which stacks the sheets or sheet bundles.

14. An image forming apparatus comprising:

an image forming section which forms an image on a sheet or sheet bundle; and a sheet processing apparatus which aligns and stacks the sheet or sheet bundle delivered from the image forming section, wherein the sheet processing apparatus is as set forth in any one of claims 10 to 13.

15. An image forming apparatus forming an image on a sheet, comprising:

an image forming section which forms an image on the sheet;

a stacking portion on which sheets or sheet bundles on which the image is formed by the image forming section are stacked;

a conveying portion which conveys the sheets or the sheet bundles toward the stacking portion;

a sheet rear end aligning portion which aligns a rear end of the sheet or the sheet bundle upon pressing toward the stacking portion, the rear end of the sheets or the sheet bundles conveyed by the conveying portion; and a controller which controls acceleration of the rear end aligning unit, such that the acceleration of the sheet rear end aligning unit is determined based on a feature of the sheet or sheet bundle being pressed and a feature of sheet stacked on the stacking portion.

16. The sheet processing apparatus according to claim 15, further comprising a processing unit capable of temporarily stacking the sheets, disposed on an upstream side of the stacking tray and the conveying portion in the sheet conveyance direction, wherein the sheets processed at the processing unit is conveyed to the stacking portion by the conveying portion.

17. The sheet processing apparatus according to claim 16, wherein the processing unit includes a processing tray capable of temporarily stacking the sheets, an aligning unit which aligns the sheets in the sheet width direction, stacked on the processing tray, and a stapler unit which staples the sheets aligned by the aligning unit.

18. The sheet processing apparatus according to claim 15, wherein the stacking portion has a stacking surface, extending substantially horizontally, which stacks the sheets or the sheet bundles.

19. The sheet processing apparatus according to claim 1, wherein the at least one feature is one of (1) a kind of sheet or sheet bundle or (2) toner amounts carried on the sheet or sheet bundle.

20. The sheet processing apparatus according to claim 6, wherein the at least one feature is one of (1) a kind of sheet or sheet bundle or (2) toner amounts carried on the sheet or sheet bundle.

* * * * *

UNITED STATES PATENT AND TRADEMARK OFFICE

CERTIFICATE OF CORRECTION

PATENT NO. : 7,296,793 B2
APPLICATION NO. : 10/826314
DATED : November 20, 2007
INVENTOR(S) : Daiju Yoshino It is certified that error appears in the above-identified patent and that said Letters Patent is hereby corrected as shown below:

COLUMN 1:
Line 24, “is” should read --are--.
Line 32, “raises” should read --arises--.

COLUMN 2:
Line 67, “can be not” should read --can not be--.

COLUMN 4:
Line 33, “lack and” should read --rack-and--.
Line 37, “are” should read --is--.
Line 38, “are” should read --is--.

COLUMN 5:
Line 26, “escape” should be deleted.

COLUMN 6:
Line 44, “require” should read --required--.

COLUMN 7:
Line 22, “means not shown” should read --means, not shown,--.
Line 27, “that” should be deleted.
Line 43, “extend,” should read --extending,--.
Line 51, “subjecting” should read --subjected--.

COLUMN 8:
Line 17, “method” (first occurrence) should read --methods--.

UNITED STATES PATENT AND TRADEMARK OFFICE

CERTIFICATE OF CORRECTION

PATENT NO. : 7,296,793 B2
APPLICATION NO. : 10/826314
DATED : November 20, 2007
INVENTOR(S) : Daiju Yoshino It is certified that error appears in the above-identified patent and that said Letters Patent is hereby corrected as shown below:

COLUMN 10:
Claim 15 line 41, “sheets” should read --sheet--.
Claim 15 line 42, “bundles” should read --bundle--.
Claim 15 line 45, “pressing” should read --pressing,--.
Claim 15 line 47, “bundles” should read --bundle--.
Claim 15 line 51, “of” should read --of the--.
Claim 16 line 59, “is” should read --are--.

Signed and Sealed this

Twenty-fourth Day of June, 2008

JON W. DUDAS
*Director of the United States Patent and Trademark Office*